US010152958B1

(12) United States Patent
Sheely

(10) Patent No.: US 10,152,958 B1
(45) Date of Patent: Dec. 11, 2018

(54) ELECTRONIC MUSICAL PERFORMANCE CONTROLLER BASED ON VECTOR LENGTH AND ORIENTATION

(71) Applicant: Martin J Sheely, Tokyo (JP)

(72) Inventor: Martin J Sheely, Tokyo (JP)

( * ) Notice: Subject to any disclaimer, the term of this patent is extended or adjusted under 35 U.S.C. 154(b) by 0 days.

(21) Appl. No.: 15/945,751

(22) Filed: Apr. 5, 2018

(51) Int. Cl.
*G10H 1/00* (2006.01)

(52) U.S. Cl.
CPC ..... *G10H 1/0041* (2013.01); *G10H 1/0008* (2013.01); *G10H 2220/391* (2013.01); *G10H 2220/401* (2013.01); *G10H 2240/165* (2013.01); *G10H 2240/171* (2013.01)

(58) Field of Classification Search
CPC ..... G10H 1/0041; G10H 1/0008; G10H 2220/391; G10H 2220/401
USPC ..... 84/615, 602
See application file for complete search history.

(56) References Cited

U.S. PATENT DOCUMENTS 3,691,675 A * 9/1972 Rodgers ..... A63H 13/16 446/188
4,526,078 A * 7/1985 Chadabe ..... G10H 1/0551 84/602
4,968,877 A * 11/1990 McAvinney ..... G10H 1/0553 250/221
5,533,949 A * 7/1996 Hwang ..... A63B 23/16 446/397
5,541,358 A 7/1996 Wheaton et al.
5,648,627 A * 7/1997 Usa ..... G10H 1/0556 706/900
6,000,991 A * 12/1999 Truchsess ..... G09F 19/08 446/397
7,060,885 B2 * 6/2006 Ishida ..... G06F 3/0346 84/609
7,183,477 B2 * 2/2007 Nishitani ..... G10H 1/0066 84/600
7,474,197 B2 1/2009 Choi et al.
8,217,253 B1 7/2012 Beaty
8,242,344 B2 8/2012 Moffatt
8,362,350 B2 1/2013 Kockovic
8,609,973 B2 12/2013 D'Amours
8,723,012 B2 * 5/2014 Mizuta ..... A63F 13/814 84/600

(Continued)

OTHER PUBLICATIONS www.proximitar.com Inventor's web site promoting product based on this patent application. (U.S. Appl. No. 15/945,751).

*Primary Examiner* — David Warren

(57) ABSTRACT

An electronic musical performance controller comprising a microprocessor, proximity sensor, gyroscope, accelerometer, narrow beam guide light, and one or more finger monitoring sensors. The proximity sensor is mounted on the front of the controller and represents the origin of a Cartesian coordinate system. Preprogrammed events are mapped into the surrounding space at fixed distances and pitch and yaw angles from the proximity sensor. The guide light beam illuminates the proximity sensor's field of view. The controller is held in one hand and the guide light beam is aimed at the other hand. When the player's finger triggers a finger monitoring sensor, the length of the guide light beam and the pitch and yaw of the proximity sensor are measured. This information is used to determine which mapped event the player is selecting. The preprogrammed event is then output via a MIDI bus or built in sound module and speaker.

8 Claims, 9 Drawing Sheets

(56) References Cited

U.S. PATENT DOCUMENTS

| | | | | |
|---|---|---|---|---|
| 8,872,014 | B2 | 10/2014 | Sandler et al. | |
| 9,024,168 | B2 | 5/2015 | Peterson | |
| 9,536,507 | B2 * | 1/2017 | Zhang | G10H 1/0008 |
| 9,646,588 | B1 | 5/2017 | Bencar et al. | |
| 9,812,107 | B2 | 11/2017 | Butera | |
| 2004/0046736 | A1 * | 3/2004 | Pryor | A63F 13/02 345/156 |
| 2006/0174756 | A1 * | 8/2006 | Pangrle | G10H 3/06 84/724 |
| 2007/0021208 | A1 * | 1/2007 | Mao | G06F 3/017 463/36 |
| 2007/0119293 | A1 * | 5/2007 | Rouvelle | G10H 1/055 84/633 |
| 2009/0308232 | A1 * | 12/2009 | McMillen | G10D 3/16 84/723 |
| 2011/0296975 | A1 * | 12/2011 | de Jong | G10H 1/0555 84/725 |
| 2012/0056810 | A1 * | 3/2012 | Skulina | G06F 3/0338 345/161 |
| 2012/0103168 | A1 * | 5/2012 | Yamanouchi | G10H 1/0008 84/723 |
| 2013/0118340 | A1 * | 5/2013 | D'Amours | G10H 1/0083 84/746 |
| 2013/0138233 | A1 * | 5/2013 | Sandler | G06F 17/00 700/94 |
| 2013/0207890 | A1 | 8/2013 | Young | |
| 2014/0007755 | A1 * | 1/2014 | Henriques | G10H 3/14 84/723 |
| 2017/0047055 | A1 * | 2/2017 | Monsarrat-Chanon | G10H 1/0553 |
| 2017/0092249 | A1 * | 3/2017 | Skulina | G01L 5/223 |
| 2018/0188850 | A1 * | 7/2018 | Heath | G06F 3/044 |

* cited by examiner

ELECTRONIC MUSICAL PERFORMANCE CONTROLLER BASED ON VECTOR LENGTH AND ORIENTATION

FIELD

The subject matter herein generally relates to electronic musical instrument technology, and particularly to an electronic musical performance device comprising sensor and microcontroller technology.

BACKGROUND

Musical instruments and media controllers utilizing sensor technology and microelectronics continue to evolve. One category of device uses this technology to emulate previously existing acoustic musical instruments, for example drums, flutes, and harps. Another area creates performance spaces in which sensors, embedded in the floor, suspended overhead, or mounted on surrounding stands, monitor the movement of the performer and translate this movement into sound. More recently, sensor technology has been integrated into clothing, where the gestures and motion of the wearer trigger sound events.

The devices that have moved beyond replicas of traditional acoustic instruments suffer from various drawbacks. Performance space systems are inherently large and difficult to set up making their adoption problematic. Clothing integrated technology, while portable, is cumbersome to wear and prone to wiring problems. In addition, the gesture, motion, and break beam based systems that are available do not allow rapid and accurate note selection limiting their playability. Accordingly, there is a need in the field for an improved electronic musical instrument that overcomes these limitations.

SUMMARY OF THE INVENTION

The invention described in this document is an electronic musical performance controller, comprising a proximity sensor responsive to change in distance between a selectively positionable member and the proximity sensor, at least one finger monitoring sensor responsive to movement of an operator's finger, at least one angle sensor responsive to change in angle of the proximity sensor around an axis, and a microcontroller configured to output a data packet when triggered by the finger monitoring sensor, wherein the output data packet varies in response to at least one of, change in distance between the selectively positionable member and the proximity sensor, and change in angle of the proximity sensor around an axis.

Having the triggering finger monitoring sensor separate from the proximity sensor achieves a technical advantage over systems that are triggered by approaching the proximity sensor or breaking a beam in that selections can be made much more rapidly and accurately. The addition of a plurality of finger monitoring sensors and a plurality of angle sensors allows many sets of different data packets from the same proximity sensor greatly expanding the number of selections available without increasing the size of the device.

DETAILED DESCRIPTION OF THE INVENTION

It is to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
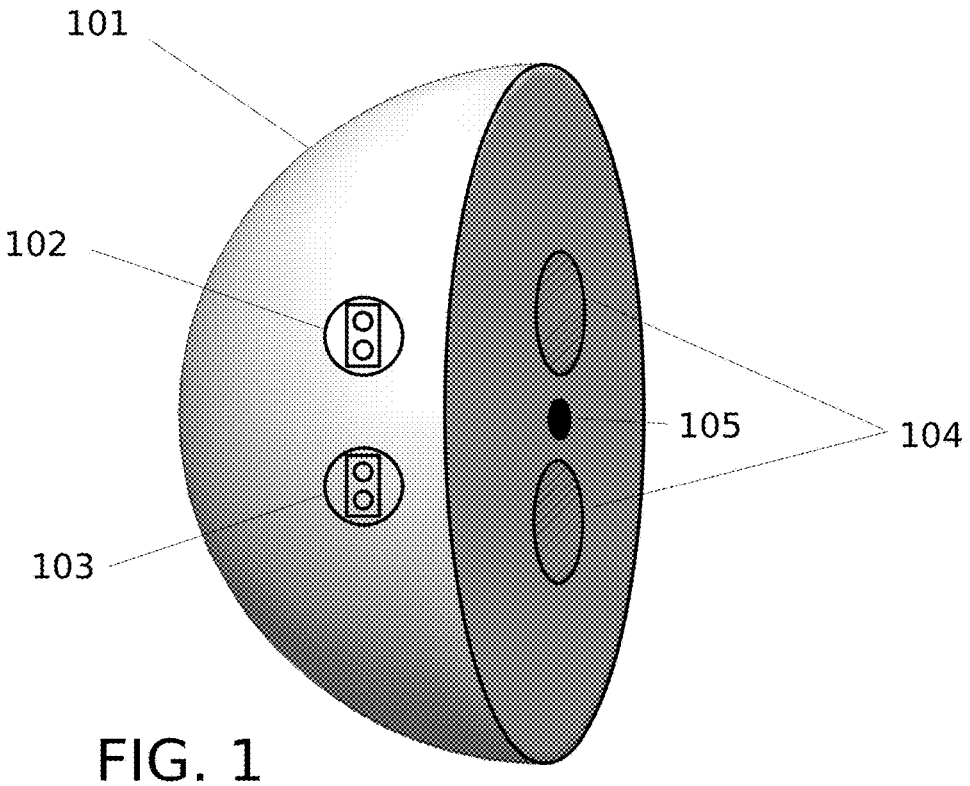
FIG. 1 is a side view of an embodiment of the instrument body.
Figure 2:
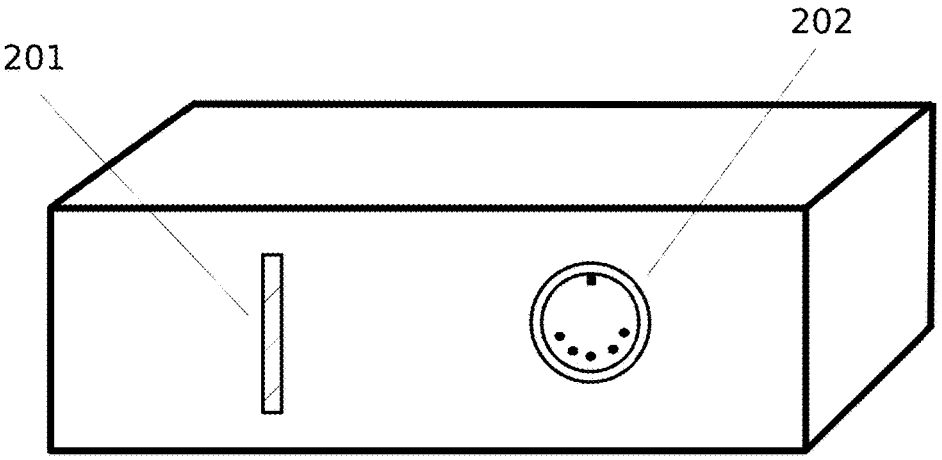
FIG. 2 shows a view of an embodiment of the base station receiver.

One embodiment of the device is comprised of a wireless hand held sensor unit shown in FIG. 1, and a base station, shown in FIG. 2.

In FIG. 1 a hemispherical body 101, two infrared reflective optical finger monitoring sensors 102 and 103, an ultrasonic proximity sensor 104, and a narrow beam guide LED 105 are shown. The proximity sensor 104 is mounted on the flat side of the body 101 projecting perpendicularly from the flat side out into space. The guide LED 105 is positioned to illuminate the center of the proximity sensor's field of view. The two finger monitoring sensors 102, 103 (upper and lower respectively) are mounted in holes that are positioned so that when the hemispherical body 101 is held in the hand, the holes are under the tips of the index and middle fingers. In FIG. 2 the base station with a slot for a memory card 201, and a MIDI (musical instrument digital interface) out jack 202 is shown.

Figure 3:
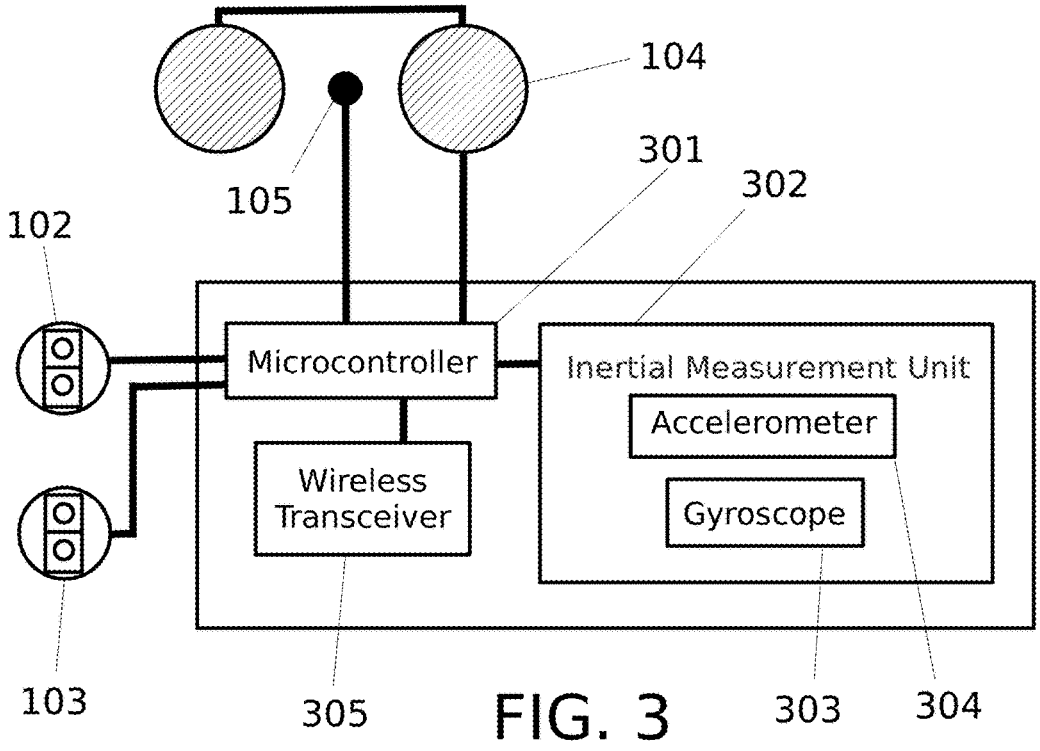
FIG. 3 is a block diagram showing the electronics inside the embodiment of the instrument body shown in FIG. 1.

FIG. 3 shows a block diagram of the electronics enclosed in the hemispherical body 101 of FIG. 1. A microcontroller 301 is connected to an inertial measurement unit 302, containing a gyroscope 303 and an accelerometer 304, and a wireless transceiver 305. The microcontroller 301 is also connected to the proximity sensor 104, the two finger monitoring sensors 102, 103, and the guide LED 105. Electronics are battery powered (battery not shown).

Figure 4:
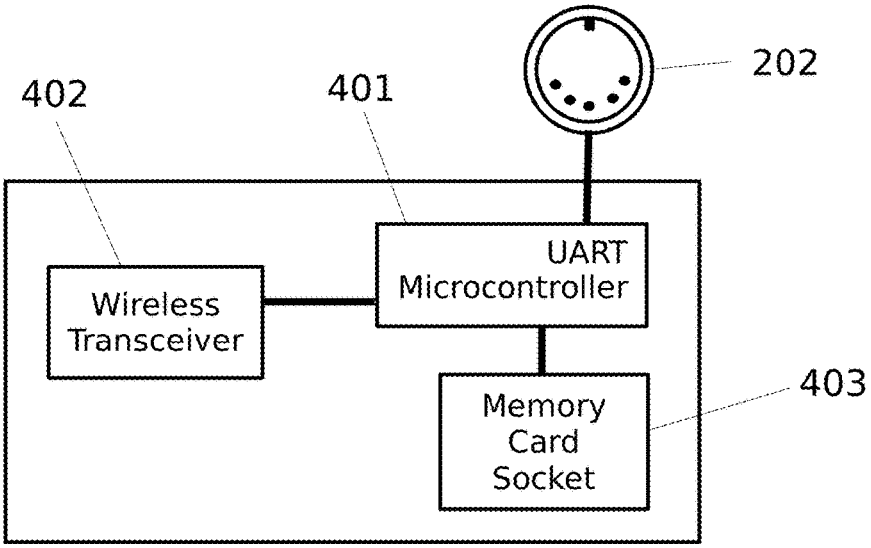
FIG. 4 is a block diagram showing the electronics inside the embodiment of the base station receiver in FIG. 2.

FIG. 4 shows a block diagram of the electronics enclosed in the base station of FIG. 2. A microcontroller 401, is connected to a wireless transceiver 402, and a memory card socket 403. The UART (Universal Asynchronous Receiver/Transmitter) of microcontroller 401 is connected to the MIDI out jack 202. Display, user interface, and power supply are not shown.

Figure 5:
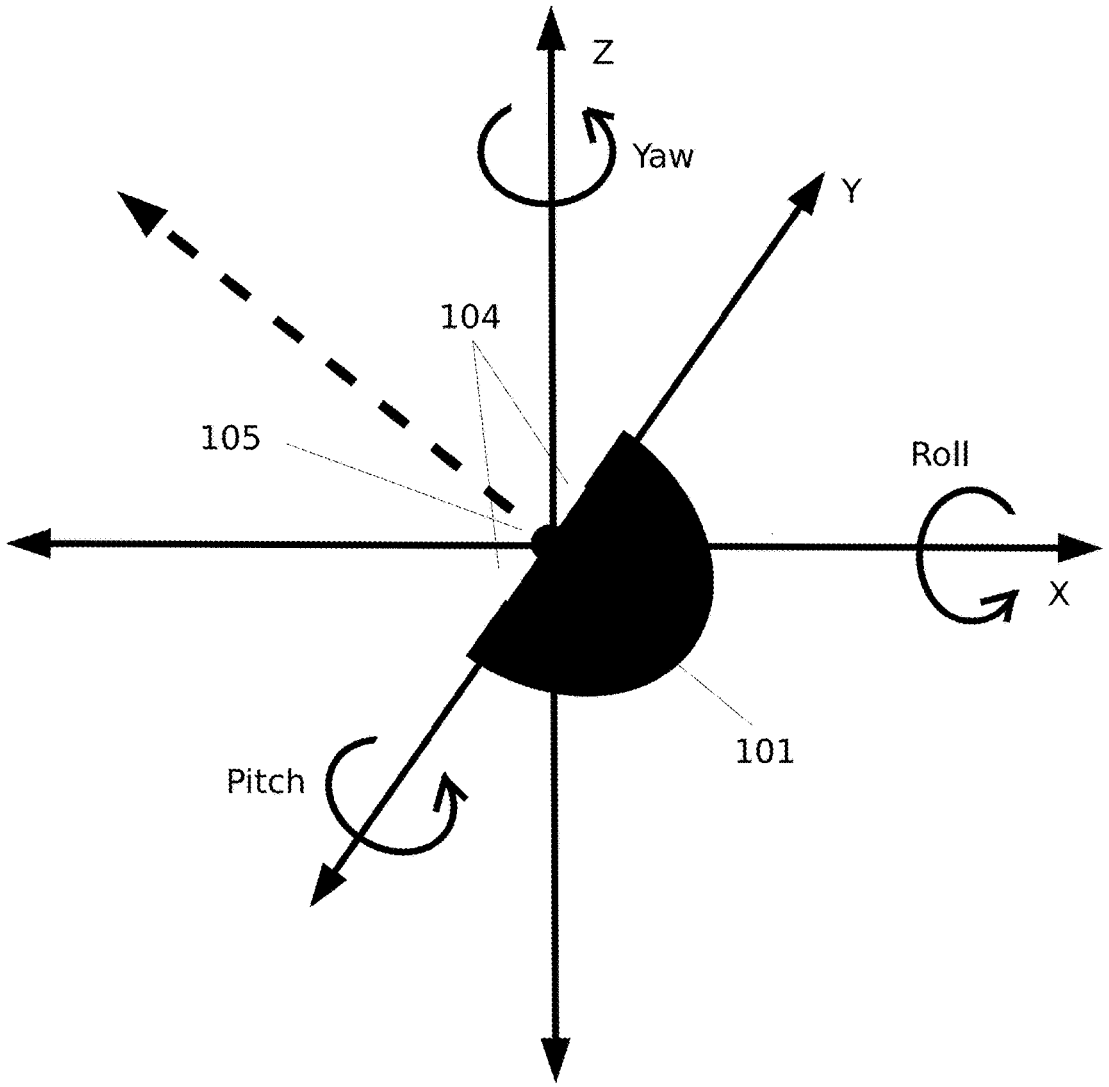
FIG. 5 shows a view of the instrument body in relation to the Cartesian coordinate system.
Figure 6:
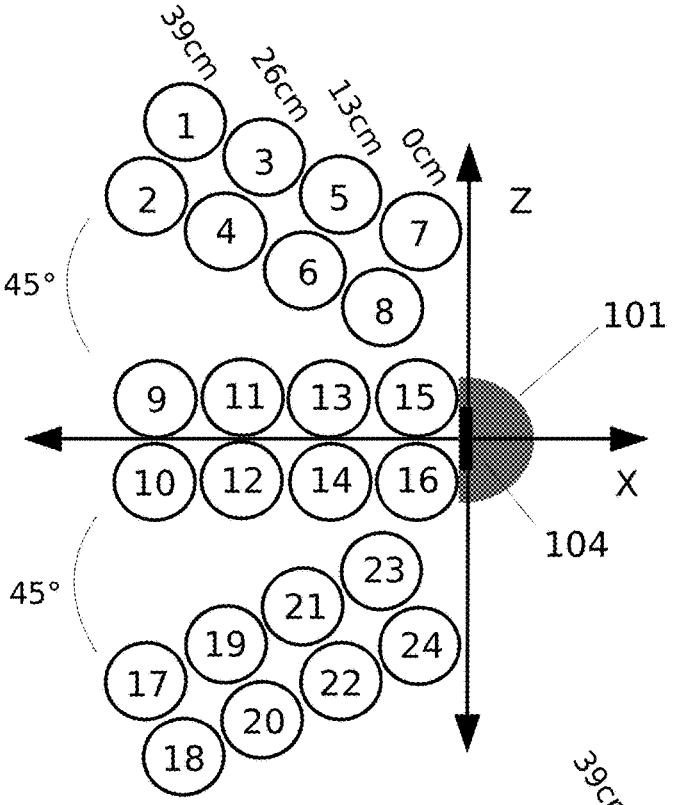
FIG. 6 shows selection group one mapped in the (−x, ±z) plane.
Figure 7:
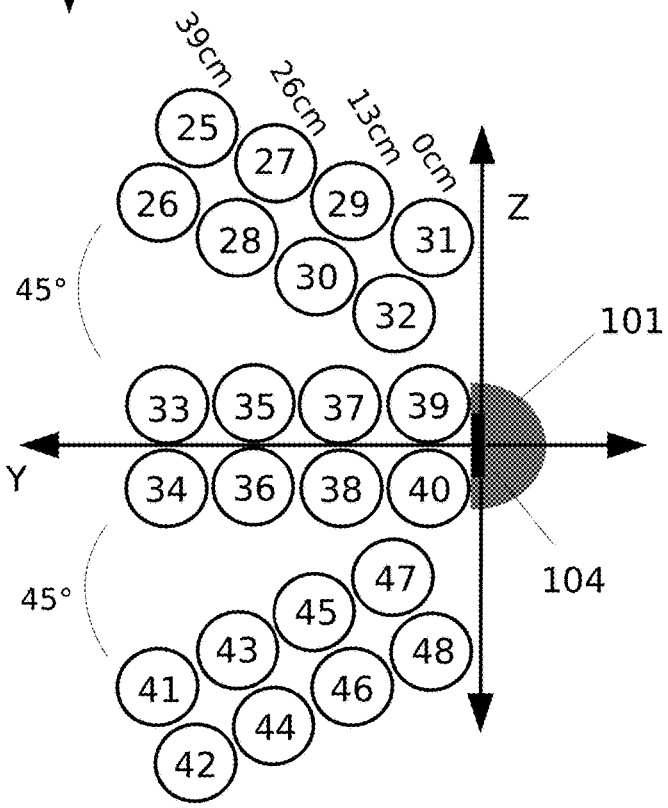
FIG. 7 shows selection group two mapped in the (+y, ±z) plane.
Figure 8:
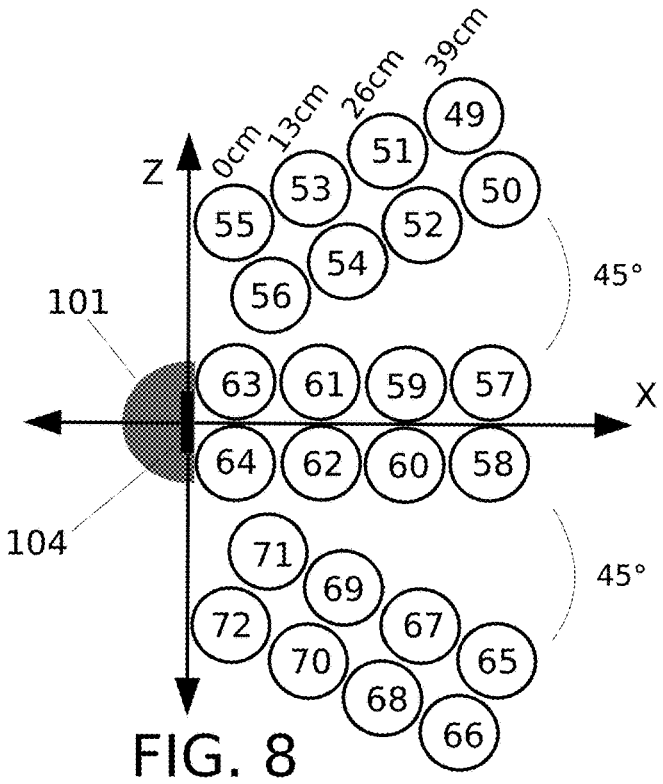
FIG. 8 shows selection group three mapped in the (+x, ±z) plane.
Figure 9:
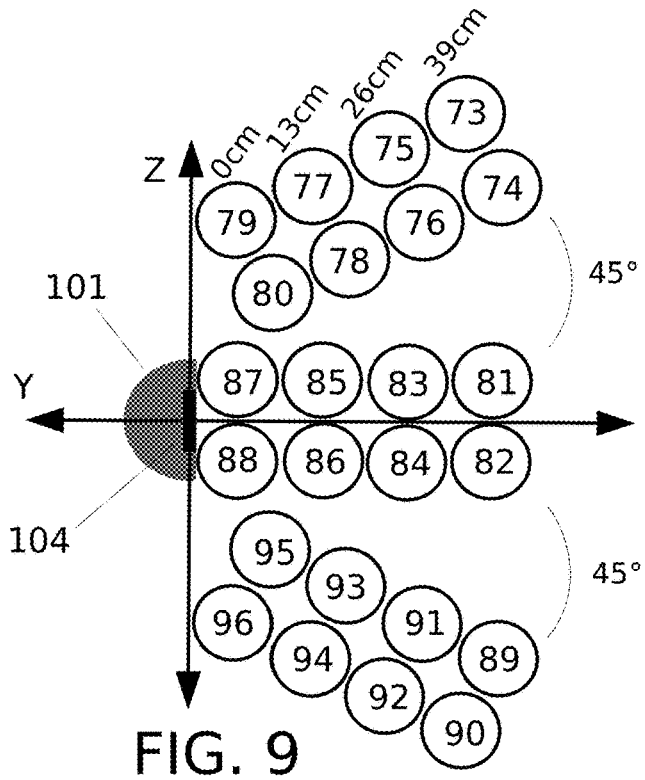
FIG. 9 shows selection group four mapped in the (−y, ±z) plane.
Figure 10:
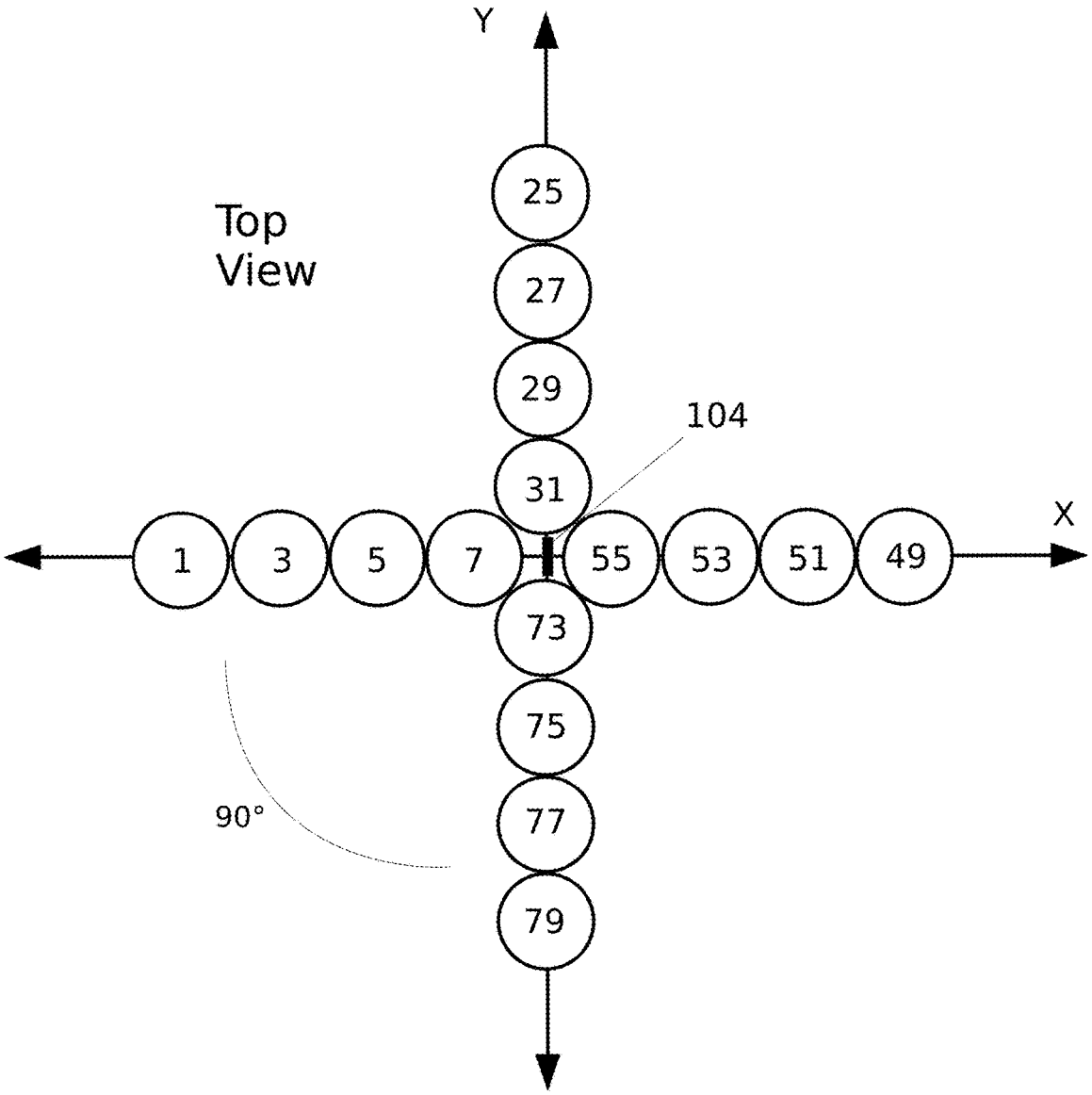
FIG. 10 shows a top view of the four selection groups in 3d space.

The proximity sensor 104 in FIG. 5, lies at the origin (x0,y0,z0) of a Cartesian coordinate system. A dashed line represents the center of the proximity sensor's field of view and is illuminated by the guide LED 105. Aircraft principal axes, yaw, pitch, and roll, are also shown with the field of view of the proximity sensor 104 being relative to the aircraft nose with its initial orientation along the −X axis.

As shown in FIG. 6, FIG. 7, FIG. 8, FIG. 9 and FIG. 10, groups of eight selections are mapped in the proximity sensor's field of view at incremental distances from the proximity sensor 104. Twelve of the groups of eight are mapped at the pitch and yaw angles shown relative to the proximity sensor 104. The 96 selections are numbered as shown.

The proximity sensor 104 is pitched up 45°, held level, or pitched down 45° to select from each group of selections. The upper finger monitoring sensor 102 and the lower finger monitoring sensor 103 correspond to the odd numbered and even numbered selections respectively. The operator can also rotate the proximity sensor at 90°, 180°, and 270° yaw intervals to change selection groups.

Data packets are programmed using computer software (not shown) and saved to a file on a memory card. The data packets contained in this file are read via the memory card socket 403, in FIG. 4. into a memory of the microcontroller 401. Each data packet in the memory contains MIDI messages corresponding to the 96 selections that are mapped in the space surrounding the proximity sensor.

Figure 11:
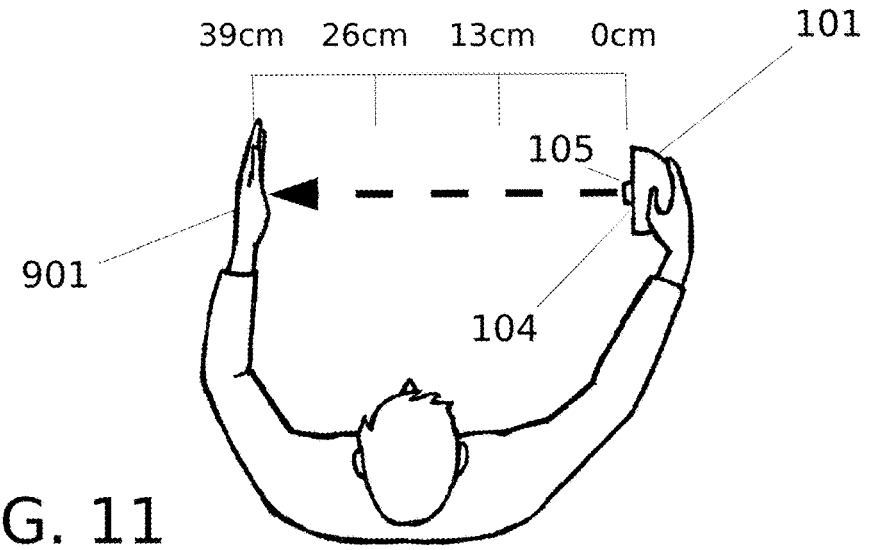
FIG. 11 is a top view of the instrument being played.
Figure 12:
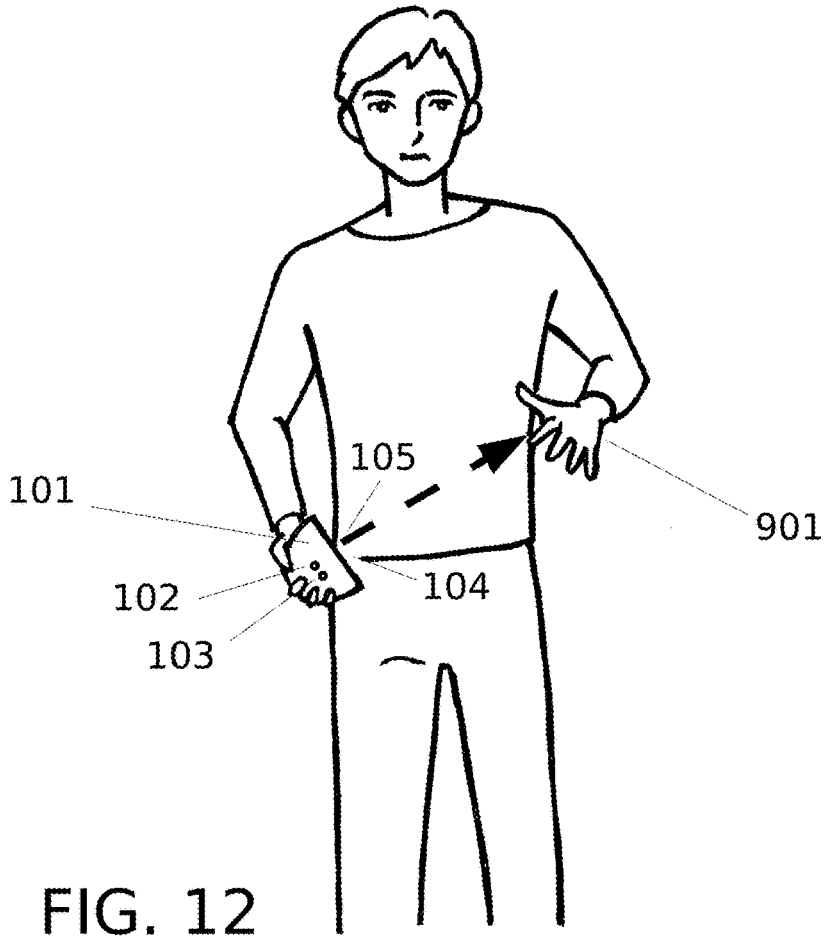
FIG. 12 is a front view of the instrument being played.

The device is held in one hand and the guide LED 105 is aimed at the free hand 901 (the selectively positionable member) as shown in FIG. 11 and FIG. 12. When the operator's finger triggers either the upper 102 or lower 103 finger monitoring sensor, an interrupt service routine (ISR) is initiated in the microcontroller 301, see FIG. 3. The microcontroller 301 then uses the proximity sensor 104 to measure the distance between the proximity sensor 104 and the free hand 901. The inertial measurement unit 302 is used to measure the pitch and yaw of the proximity sensor 104. Using the pitch, yaw, and distance data the microcontroller 301 calculates which selection the operator is choosing and transmits a data packet including the selection number via the wireless transceiver 302 to the wireless transceiver 402 of the base station of FIG. 4. The base station microcontroller 401 then sends the corresponding data packet of MIDI messages from memory, out its UART onto the MIDI bus via the MIDI out jack 202 which is connected to a standard MIDI sound synthesizer/sampler voice module.

When the operator's finger disengages either the upper 102 or lower 103 finger monitoring sensor, the microcontroller 301 then outputs a selection released data packet which is sent via the wireless transceiver 302 to the wireless transceiver 402 of the base station of FIG. 4. The base station microcontroller 401 then sends the corresponding data packet of MIDI messages from memory, out its UART onto the MIDI bus via the MIDI out jack 202.

Rotating the proximity sensor 104 around the X axis changes the roll angle, see FIG. 5, wherein the microcontroller 301 outputs data packets related to effects such as musical pitch bend.

The device can be operated in 3d mode, as described above, or in 2d mode. In a 2d mode where only pitch angle is used, the operator chooses from 24 selections positioned in the (−x, ±z) plane, see FIG. 6. In a 2d mode where only yaw angle is used, the operator chooses from 32 selections positioned in the (±x, ±y) plane. Alternative embodiments can operate in 2d mode exclusively.

Figure 13:
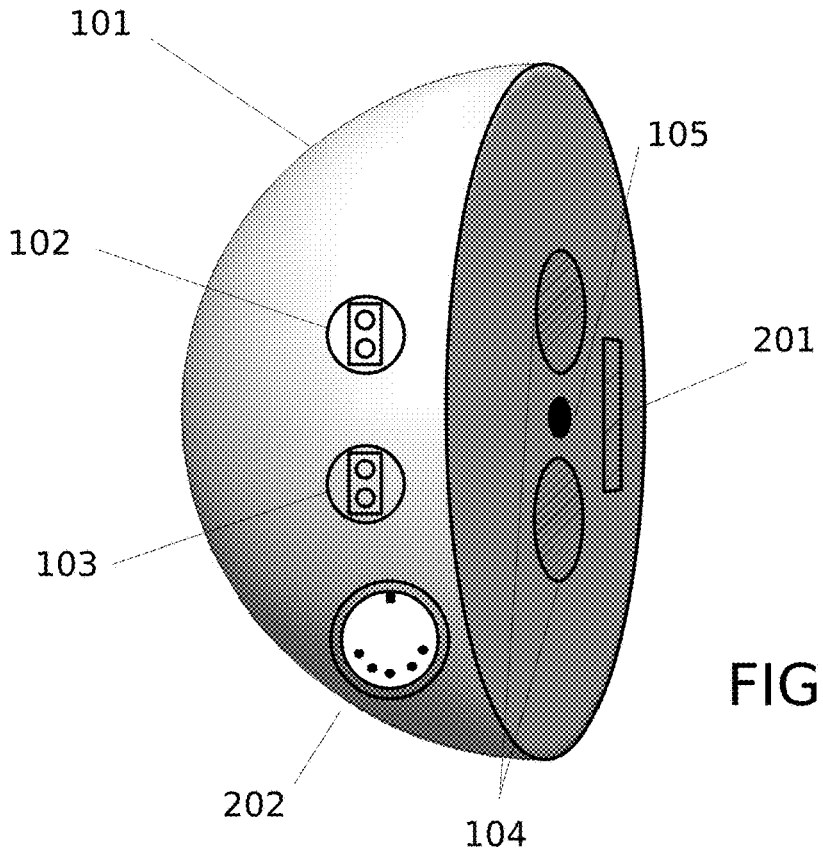
FIG. 13 is a side view of an embodiment of the instrument body.
Figure 14:
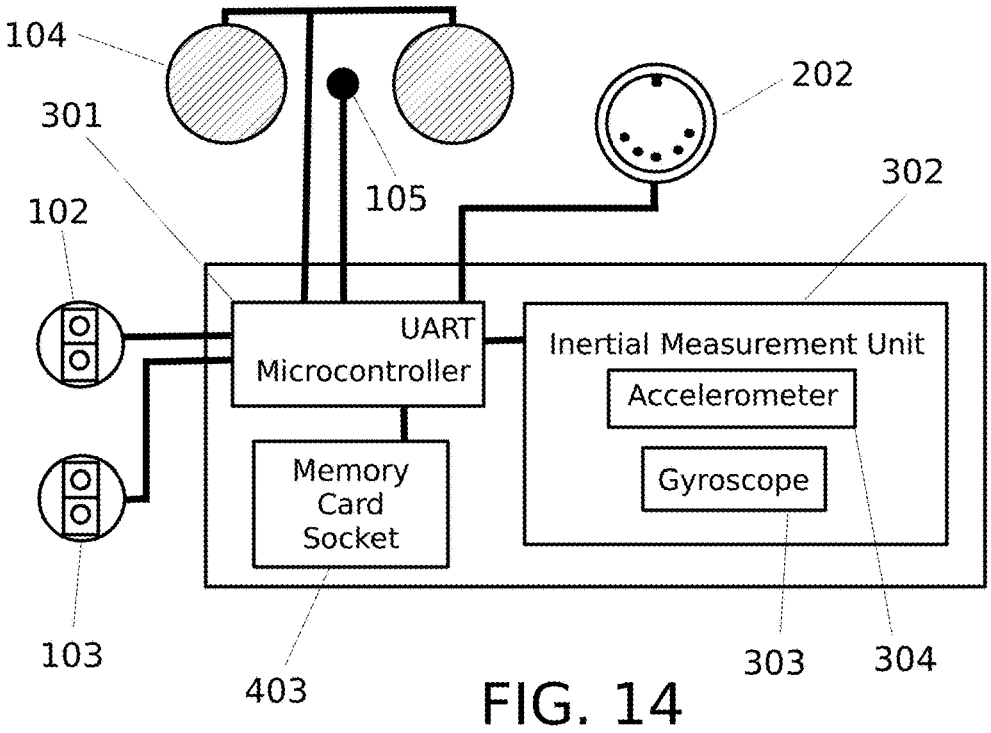
FIG. 14 is a block diagram showing the electronics inside the embodiment of the instrument body shown in FIG. 13.

In another embodiment of the device the MIDI out jack 202, and the memory card slot 201 and socket 403, are incorporated directly into the body 101, see FIG. 13 and FIG. 14. Data packets are read via the memory card socket 403 into memory of the microcontroller 301. Each data packet in the memory contains MIDI messages corresponding to the 96 selections that are mapped in the space surrounding the proximity sensor as described above. Electronics are battery powered (battery not shown).

The device is held in one hand and the guide LED 105 is aimed at the free hand 901 (the selectively positionable member) as shown in FIG. 11 and FIG. 12. When the operator's finger triggers either the upper 102 or lower 103 finger monitoring sensor, an interrupt service routine is initiated in the microcontroller 301, see FIG. 14. The microcontroller 301 then uses the proximity sensor 104 to measure the distance between the proximity sensor 104 and the free hand 901. The inertial measurement unit 302 is used to measure the pitch and yaw of the proximity sensor 104. Using the pitch, yaw, and distance data the microcontroller 301 calculates which selection the operator is choosing and then sends the corresponding data packet of MIDI messages from memory, out its UART onto the MIDI bus via the MIDI out jack 202 which is connected to a standard MIDI sound synthesizer/sampler voice module.

When the operator's finger disengages either the upper 102 or lower 103 finger monitoring sensor in FIG. 14, the microcontroller 301 then outputs a selection released data packet which then sends the corresponding data packet of MIDI messages from memory, out its UART onto the MIDI bus via the MIDI out jack 202.

Figure 15:
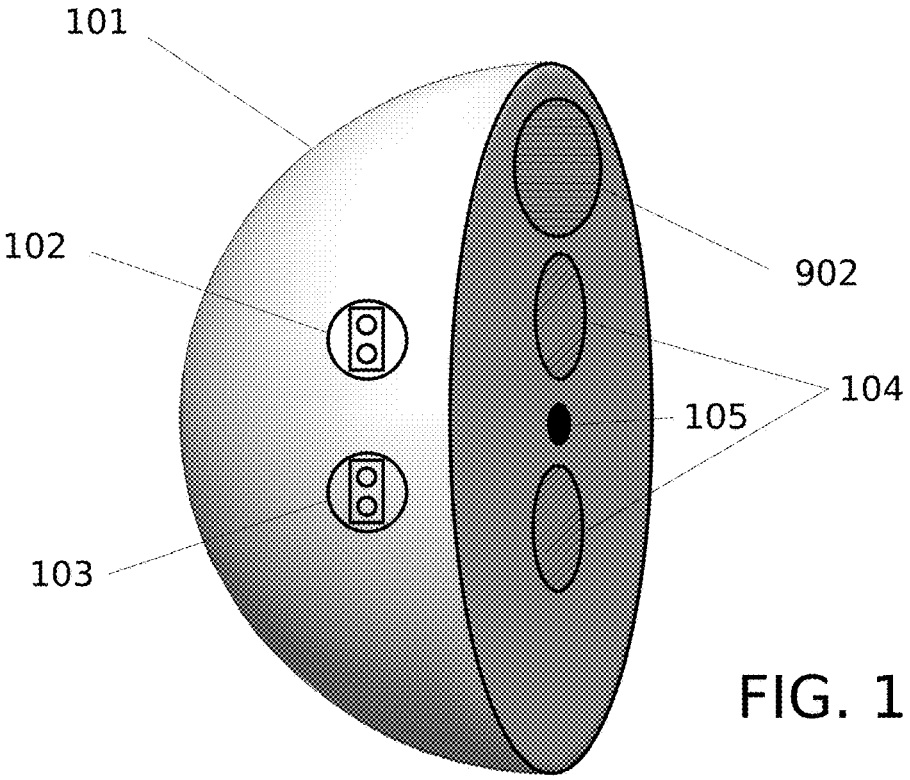
FIG. 15 is a side view of an embodiment of the instrument body.
Figure 16:
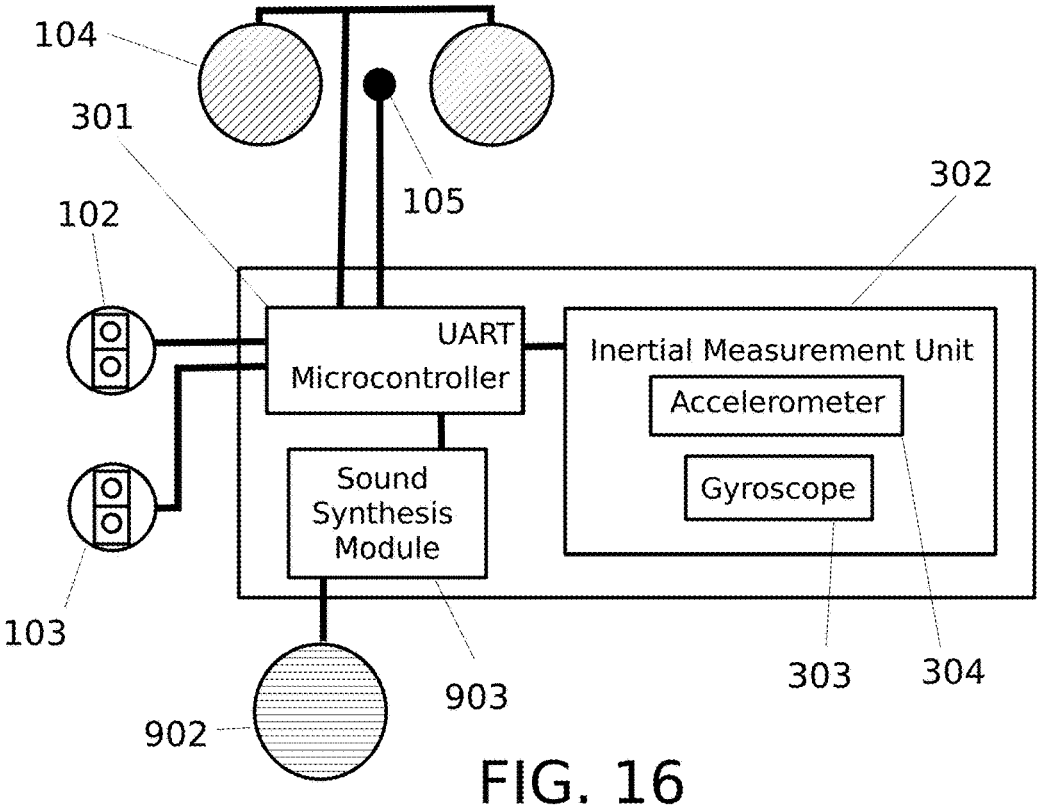
FIG. 16 is a block diagram showing the electronics inside the embodiment of the instrument body shown in FIG. 15.

In an alternate embodiment, a speaker 902 and a sound synthesis module 903, are incorporated directly into the body 101, see FIG. 15 and FIG. 16. Electronics are battery powered (battery not shown).

When the operator's finger triggers either the upper 102 or lower 103 finger monitoring sensor, an interrupt service routine is initiated in the microcontroller 301, see FIG. 16. The microcontroller 301 then uses the proximity sensor 104 to measure the distance between the proximity sensor 104 and the free hand 901 as shown in FIG. 11 and FIG. 12. The inertial measurement unit 302 is used to measure the pitch and yaw of the proximity sensor 104. Using the pitch, yaw, and distance data the microcontroller 301 calculates which selection the operator is choosing and then sends preprogrammed data to the sound synthesis module 903. These sounds are then output through speaker 902.

When the operator's finger disengages either the upper 102 or lower 103 finger monitoring sensor, the microcontroller 301 then outputs a selection released data packet to the sound synthesis module 903.

Alternative types of proximity sensors, angle sensors, and finger monitoring sensors can be substituted in the above embodiments. Additional selections can be mapped in the space surrounding the proximity sensor.

The invention claimed is:

1. An electronic musical performance controller, comprising:

a guide light beam projecting onto a selectively positionable member; and a sensor responsive to change in length of the guide light beam; and an angle sensor responsive to change in angle of the guide light beam around an axis; and a finger monitoring sensor responsive to movement of an operator's finger; and a controller configured to output a data packet when triggered by the finger monitoring sensor, wherein the output data packet varies in response to at least one of change in length of the guide light beam and change in angle of the guide light beam around an axis.

2. The electronic musical performance controller as specified in claim 1 further comprising:

a plurality of finger monitoring sensors, wherein each additional finger monitoring sensor corresponds to a different set of data packets.

3. The electronic musical performance controller as specified in claim 1 further comprising:

a plurality of angle sensors responsive to angle changes around multiple axes.

4. The electronic musical performance controller as specified in claim 1 further comprising:

a hand held component mounting structure.

5. A method of selecting a musical performance data packet, comprising:

providing a guide light beam projecting onto a selectively positionable member; and providing a sensor responsive to change in length of the guide light beam; and providing an angle sensor responsive to change in angle of the guide light beam around an axis; and providing a finger monitoring sensor responsive to movement of an operator's finger; and providing a controller configured to output a data packet when triggered by the finger monitoring sensor, wherein the output data packet varies in response to at least one of change in length of the guide light beam and change in angle of the guide light beam around an axis.

6. The method of selecting a musical performance data packet specified in claim 5 further comprising:

providing a plurality of finger monitoring sensors, wherein each additional finger monitoring sensor corresponds to a different set of data packets.

7. The method of selecting a musical performance data packet specified in claim 5 further comprising:

providing a plurality of angle sensors responsive to angle changes around multiple axes.

8. The method of selecting a musical performance data packet specified in claim 5 further comprising:

providing a hand held component mounting structure.

* * * * *